US005527026A

United States Patent [19]

Padget et al.

[11] Patent Number: 5,527,026

[45] Date of Patent: Jun. 18, 1996

[54] AUTO COMPENSATING PAPER FEEDER

[75] Inventors: Martin J. Padget, Oceanside, Calif.; John A. Schmidt; Scott S. Williams, both of Lexington, Ky.

[73] Assignee: Lexmark International, Inc., Greenwich, Conn.

[21] Appl. No.: 406,233

[22] Filed: Mar. 17, 1995

[51] Int. Cl.[6] ..... B65H 3/30

[52] U.S. Cl. ..... 271/21; 271/117; 271/121; 271/170

[58] Field of Search ..... 271/21, 117, 118, 271/121, 126, 169, 170, 109

[56] References Cited

U.S. PATENT DOCUMENTS

| | | | |
|---|---|---|---|
| 2,993,438 | 7/1961 | Stephenson | 271/170 |
| 3,029,074 | 4/1962 | Springer | 271/170 |
| 3,306,491 | 2/1967 | Eisner et al. | 271/117 |
| 4,577,849 | 3/1986 | Watanabe | 271/21 |
| 4,925,177 | 5/1990 | Nakamura et al. | 271/110 |
| 4,934,686 | 6/1990 | Ono et al. | 271/117 |
| 4,960,273 | 10/1990 | Irystak et al. | 271/117 |
| 5,085,420 | 2/1992 | Sata | 271/118 |
| 5,377,970 | 1/1995 | Kikuchi | 221/121 |

*Primary Examiner*—H. Grant Skaggs
*Attorney, Agent, or Firm*—John A. Brady

[57] ABSTRACT

A gear train (1) pivoted (11) around its drive gear (3) rotates a drive roller (13) with increasing pressure until the top sheet of paper (15) is moved. The corner buckler (19) is moved around a pivot (25) under the paper tray to drive the buckler into the paper stack. A bottom roller (27) permits the drive roller to rotate when the tray is empty. To reduce the angular variation of the gear train, its pivot point may be lowered by positioning it to the side of the tray. The assembly adjusts automatically to correct feeding variations.

6 Claims, 4 Drawing Sheets

AUTO COMPENSATING PAPER FEEDER

TECHNICAL FIELD

This invention relates to paper feeders with compensating pick or feed rollers and to paper feeder with corner bucklers, or dams.

BACKGROUND OF THE INVENTION

With paper picking devices there exists a critical normal force relationship between the pick roller and the paper stack. Too much normal force will result in multi-feeds and too little normal force will result in fails to feed. In conventional devices either the paper stack or the pick roll is spring loaded against the other to provide normal force for picking. Even with extensive tuning of this force the result is usually a very narrow range of media that will run reliably. These systems are vulnerable to a couple of media characteristics: Density or net weight, and stiffness. When the paper stack is spring loaded, density or net weight of the media can vary the resultant normal force. When the pick roller is spring loaded against the paper, the problem of counterbalancing the paper weight is eliminated but the media stiffness is still a problem. Presently, the common way to deal with these problems is through a force adjustment mechanism that requires operator intervention when switching from media to media. U.S. Pat. No. 3,306,491 to Eisner et al shows a driver roller on a pivoted gear train as is true for this invention, but without mention of auto compensation. U.S. Pat. No. 4,934,686 to Ono et al shows a drive roller on a pivoted arm, but not with auto compensation from a gear train.

DISCLOSURE OF THE INVENTION

This invention solves both of these problems. There are no springs used in this picking device. The pick roll is mounted on a rotating swing arm. The roll rests on the paper stack. When pick roll drive is initiated through a gear located on the pivot shaft of the swing arm and counter rotating to the direction of feed, a torque is applied to the swing arm through the downstream gear train which rotates the swing arm and pick roll into the paper stack. The normal force generated is dictated by the buckling resistance of the media being picked. In theory, the normal force generated is no more than is required to buckle a single sheet of media plus the frictional resistance between the first and second sheet. Therefore; as long as the required buckling force of the media is greater than the frictional resistance of the second sheet, multifeeding is a physical impossibility. After the sheet has buckled the normal force automatically seeks equilibrium dictated by the frictional drag between the first and second sheet. The beauty of this picking device is that it never delivers more normal force than what is required to feed a single sheet of media, yet its picking power is virtually unlimited.

Another unique feature of this device is that after drive to the pick roll is discontinued the sheet in process will impart rotation to the pick roll that causes the swing arm to rotate up off of the stack to a point where the normal force theoretically goes to zero. Therefore: if the swing arm is counterbalanced such that at rest the normal force is zero, then the need for overrunning clutches or gear train disengagement is eliminated. Minimal drag will be imparted to sheet in process even though the pick roll is not turning.

Because of the unlimited pick power of this device picking with no paper present in the device can be disastrous. To solve this problem the restraint pad, normally found in corner buckler designs, has been replaced with a pressure sensitive restraint roll. The restraint roll is a high friction roll located under the pick roll. It is biased up by a resilient spring against the bottom of the tray such that the friction between the roll and the tray will not allow it to rotate during normal feeding. When the tray is empty the pick roll will eventually deliver enough normal force to overcome the spring loading of the restraint roll against the tray bottom, driving it down out of engagement with the tray and allowing it to rotate freely. Other ways to deal with this problem include sensing out of paper and not picking, torque limiting the drive to the pick roll, and just stalling the motor that is delivering power to the pick roll.

Another weakness of corner buckler picking mechanisms from a reliability standpoint is what is known as corner buckler hang. Corner buckler hang occurs when the buckle forms in the wrong direction, driving the buckler up off of the stack and wedging the sheet under the buckler usually resulting in a jam. This feeder is more resistant to this problem because of the strategic location selected for the corner buckler pivot point. By locating the pivot of the corner buckler below the bottom of the paper stack, when the paper is driven into the buckler, a rotational force acts on the buckler driving it down into the paper stack helping to counter the forces trying to lift the corner buckler.

BRIEF DESCRIPTION OF THE DRAWINGS

The details of this invention will be described in connection with the accompanying drawings, in which.

BEST MODE FOR CARRYING OUT THE INVENTION

Figure 1:
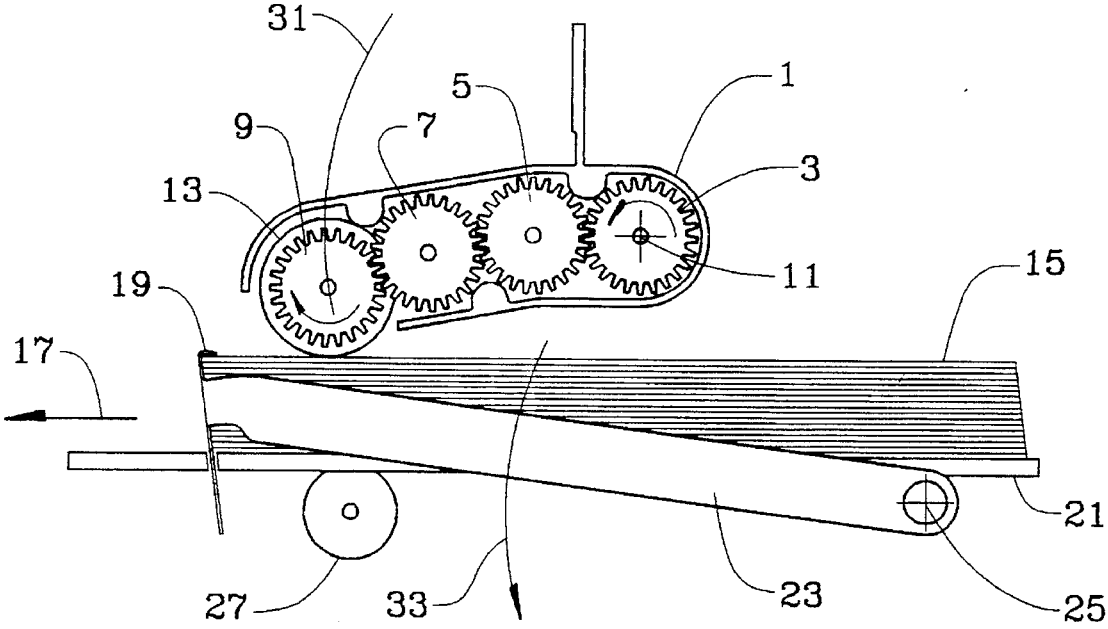
FIG. 1 shows an illustrative implementation with paper in the tray.

FIG. 1 is an illustrative embodiment with swing arm 1 carrying a train of gears 3, 5, 7 and 9. Swing arm 1 is pivoted at point 11, which is at the center of gear 3. Gear 9 is integral with a larger, driver roller 13.

Driver roller 13 resets on the top of paper stack 15, and function as a pick roller to move the top sheet of paper stack 15 in the feed direction, shown illustratively as arrow 17. As is conventional for corner buckler systems, corner buckler 19 is a rigid metal tab generally parallel with the surface of paper stack 15 which during pick operation by drive roller 13 causes the top sheet of paper stack 15 to bow upward, followed by the sheet then moving decisively over buckler 19.

Paper stack 15 rest on a stationary tray 21. Corner buckler 19 is integral with a pivot arm 23 which rotates on pivot 25 located under tray 21. Pivot arm 23 is in the order of magnitude of 10 inches in length.

Roller 27 is positioned under tray 21 and positioned to be contacted by drive roller 13 when tray 21 is empty. It is moveable vertically upward under the action of a spring 29 (FIG. 2) and passes through a hole 31 in tray 21.

In operation to feed paper gear 3 is rotated counterclockwise, as by a motor (not shown). This immediately places a counterclockwise torque on swing arm 1 which is free to move on pivot 11 (shown illustratively by arrow 31). The gear train of gears 3, 5, 7 and 9 also translates rotary force to turn gear 9, and therefore drive roller 13, clockwise. The top sheet of paper stack 15 is pressed with increasing forces until roller 9 begins to rotate, which terminates the previous torque around pivot 11 correspondingly. As the paper stack 15 becomes lower by feeding of sheets, arm 23 moves downward under gravity (shown illustratively by arrow 33). Paper from stack 15 when driven in the feed direction also tends to drive arm 23 downward. This automatically repositions the corner buckler 19 for best operation. (This invention also functions well with a simple ramp surface facing paper 15, conventionally termed a dam. The advantage of a dam is ease of paper loading.)

Figure 2:
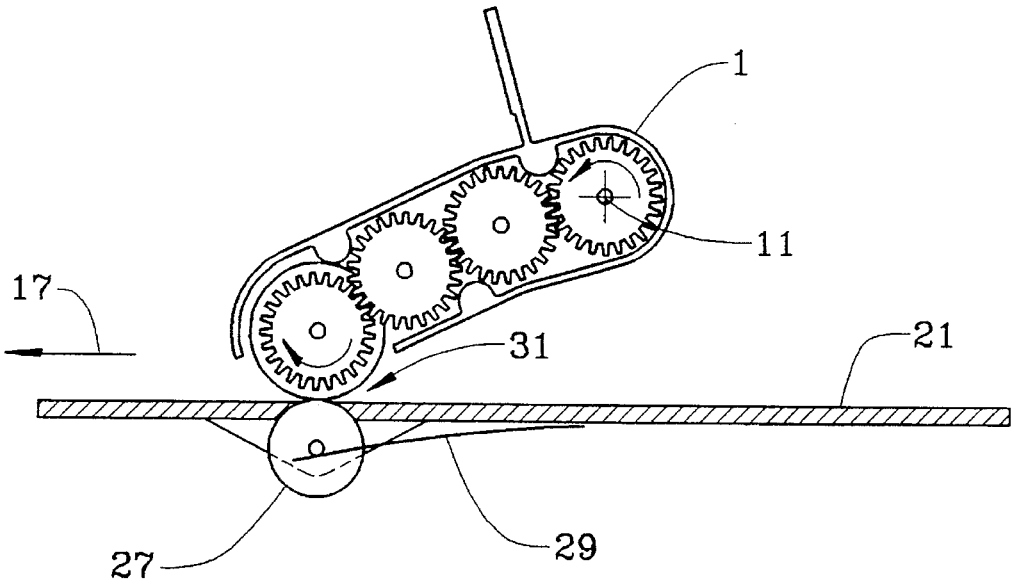
FIG. 2 shows a portion of the same embodiment as FIG. 1 when the paper tray is empty.

Since the pivot force of swing arm 11 is theoretically unlimited until gear 9 turns, roller 27 is provided to present a turning surface when tray 25 is empty, as shown in FIG. 2.

ALTERNATIVE EMBODIMENT

The illustrative configuration pictured in FIGS. 1 and 2, has a strict limitation on paper stack height since the swing arm 1 and it's gear train of gears 3, 5, 7, and 9 are cantilevered out over the paper stack 15. Also, since the swing arm pivot 11 is above the paper stack 15 and the corner buckler pivot 25 is below the paper stack 15, the distance from the drive roller 13 to the corner buckler 19 varies considerably from a full stack 15 to an empty stack 15 as the swing arm pivot 11 was raised to increase capacity, this situation becomes a problem.

An alternate configuration, that solves the capacity issue, moves the swing arm 1 over at the side of the paper stack 15, outside its retaining boundary or wall, and only cantilevers the drive roller 13 out over the paper 15. This allows the swing arm pivot 11 to be moved down toward the center of the paper stack, reducing the variation in the distance from the corner buckler 19 to the drive roller 13 by a factor 5.

Figure 3:
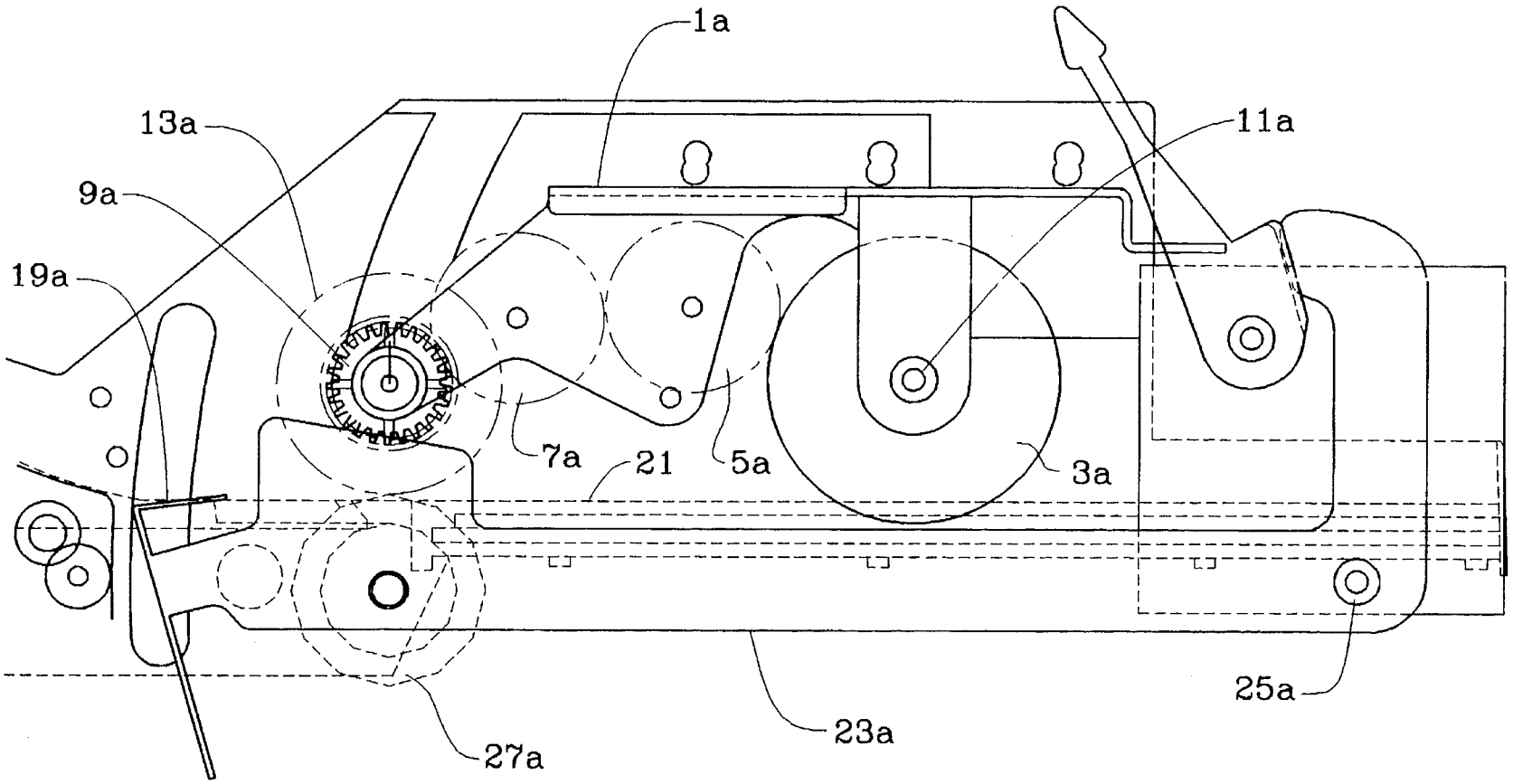
FIG. 3 shows preferred embodiment in which the pivot point is lower by placing the swing arm outside the paper tray.

This is shown in FIG. 3, in which corresponding elements are given the same number as in FIG. 1, with a suffix "a", even though they are somewhat changed as discussed above. FIG. 3 shows the paper tray 21 empty and the apparatus therefore is the status of FIG. 2. The lower position of pivot point 11, opposite a level in tray 21 used to contain paper **15*a*, reduces the angular variation of drive roller 13*a* with large paper stacks 15 in tray 21**.

THEORY

Objective

The objective of this analysis is to determine the parameters under which the bellcrank type paper picking mechanism will function. In order to accomplish this, a force balance will be carried out on the mechanism in terms of assigned variables. Analytical relationships that describe the mechanism will be derived and these will allow one to easily assess the validity of a given design.

Problem Statement

Figure 4:
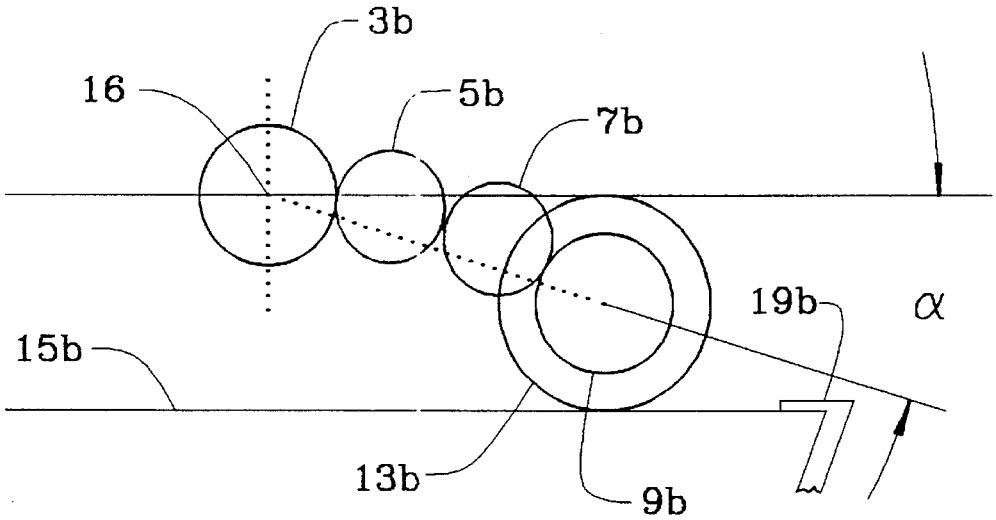
FIG. 4–FIG. 7 support a discussion of an analysis of operation and design in accordance with this invention.

A diagram of the mechanism can be found on FIG. 4, in which elements corresponding to those in FIG. 1 are given the same number as in FIG. 1 with the suffix "b", the bellcrank axis is 16, the drive gear is **3*b*, the next idler gear is 5*b*, the next idler gear is 7*b*, the next idler gear is 9*b*, the pick roller is 13*b*, the paper is 15*b* and the corner buckler is 19*b***.

The operation of this mechanism is fairly simple. The drive gear **3*b* has an applied clockwise torque. Assuming that the pick roller 13*b* does not slip and start to rotate, the applied torque will cause an increased normal force between the pick roller 13*b* and the top sheet of paper 15*b*. The gear train 3*b*, 5*b*, 7*b* and 9*b* will remain locked and the normal force will continue to build up until the paper 15*b* buckles. Once this occurs, the pick roller 13*b* will continue to drive the paper 15*b*** forward until it is passed on to a second drive roller (not shown).

Analysis

Figure 5:
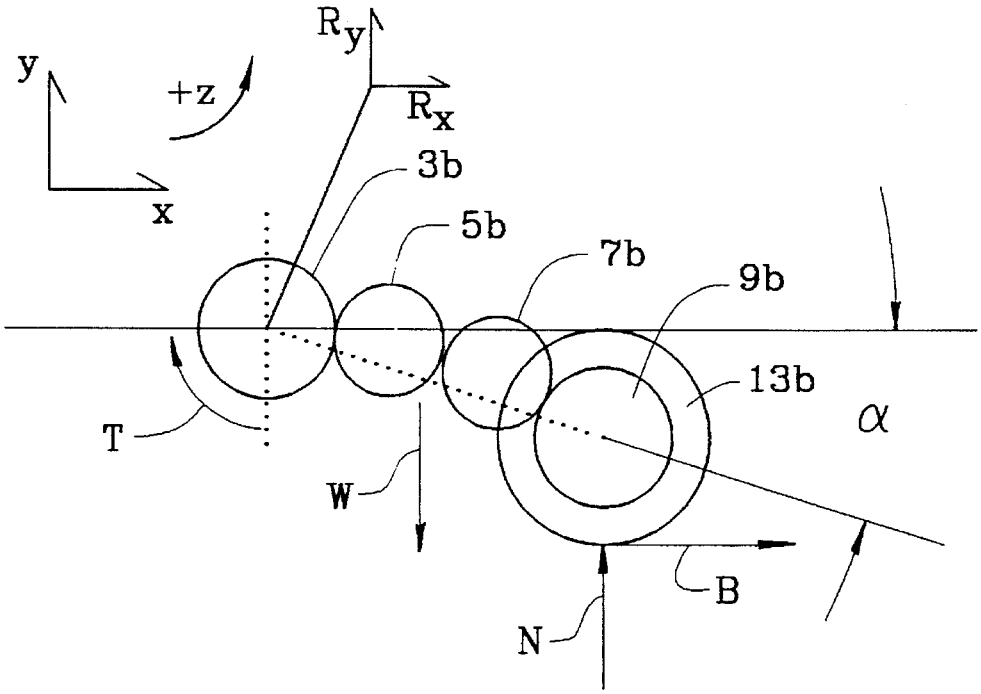

The simplest method of analyzing the mechanism is to construct free body diagrams of each component. The first is the model of the bellcrank with this gear locked. It is shown on FIG. 5, in which Ry and Rx are the reaction applied at axis, T is the input force, W is weight, N is normal for, B is buckling force, and X is a positive angle.

Summing the forces in the x and y direction yields:

$$\Sigma F_x = R_x - B = 0$$

and, $$\Sigma F_y = R_y + N - W = 0$$

However, the most useful result is found from the balance of the moments about the bellcrank's axis.

$$\Sigma M_{axis} = N \cdot L \cos(\propto) - W \cdot d \cdot \cos(\propto) - B \cdot R_r + L \cdot \sin(\propto)) - T = 0$$

where, d=distance from the axis of rotation to the center of gravity of the mechanism L=distance from the axis of rotation to the pick roller 13 axis.

Figure 6:
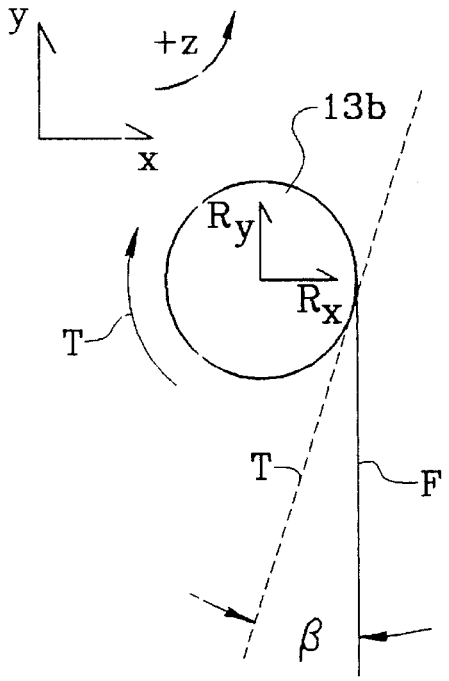

The next important analysis is of the drive gear **13*b* by itself. This can be found on FIG. 6, in which F is force in the y direction and B is the angle between the force and a tangent to 13*b* and $R_1$ is the radius of drive gear 13*b***.

Summing the moments about the axis of rotation, the following equation may be obtained.

$$T = F \cdot R_1 \cdot \cos(\beta).$$

Figure 7:
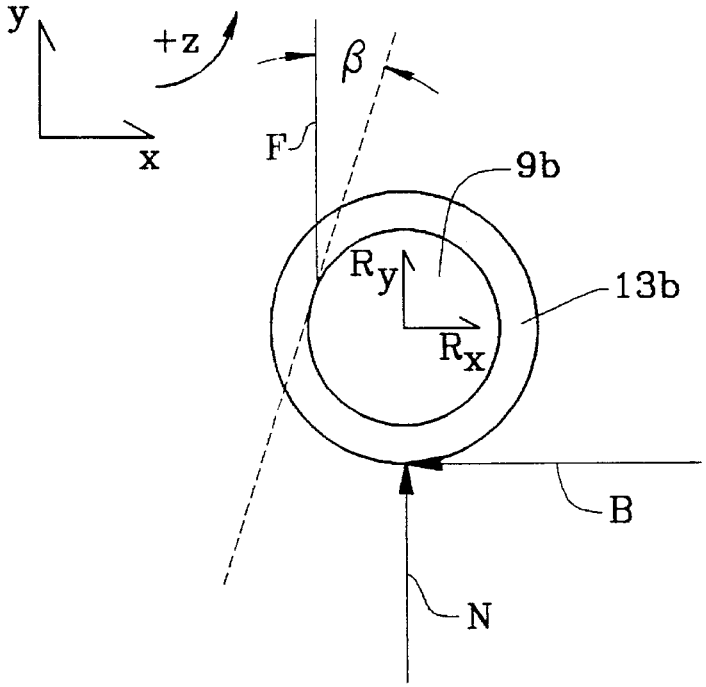

The final relationship can be determined from the gear **9*b*/pick roller 13*b* geometry. This is simplified by the fact that the force that drives this gear is equal in magnitude to F (because forces on gear teeth, not torque, are transmitted through a gear train at the same magnitude). FIG. 7 shows the force balance for the pick roller 13*b* and gear 9*b***. Again, summing the moments about the axis of rotation yields:

$$\Sigma M = F \cdot R_4 \cdot \cos(\beta) - B \cdot R_r = 0.$$

However, equation 5 only pertains to the instant at which the paper starts to buckle. To get a more useful result, the buckling force, B, can be related to the normal force, N, via the following:

$$B \geqq f_s N.$$

Thus, from the beginning of the pick cycle until the start of buckling, Equations 5 and 6 can be combined to obtain:

$$F \cdot R_4 \cdot \cos(\beta) = f_s \cdot N \cdot R_r.$$

It should be noted that this approach assumes that the pick roll will not slip. This is acceptable, because it allows one to construct relationships that will ensure that slipping does not occur.

Combining Equations 3, 4, and 7 with general knowledge about the mechanism, one will find that if the following simplified inequality holds, the mechanism should work adequately.

$$f_s \cdot N \cdot \frac{R_1 \cdot R_r}{R_4} + f_s \cdot N \cdot (R_r + L \cdot \sin(\propto)) + W \cdot d \cdot \cos(\propto) \geqq L \cdot N \cdot \cos(\propto)$$

In order to evaluate the effects of tilting the entire mechanism relative to horizontal, one modification to Equation 8 must be made. The term involving the weight must be adjusted to account for the angle at which the entire mechanism is tilted, θ, as follows.

$$f_s \cdot N \cdot \frac{R_1 \cdot R_r}{R_4} + f_s \cdot N \cdot (R_r + L \cdot \sin(\propto)) + W \cdot d \cdot \cos(\propto + \theta) \geqq L \cdot N \cdot \cos(\propto)$$

Equation 9 is valid for all situations and should be used to evaluate any the mechanism in its final design stages. However, a very conservative estimate of a given geometry's potential to operate successfully can be had from a much simpler equation.

By removing the contributions of the weights (which always helps to add picking force) and the moment caused by the buckling force (which assists the auto compensating effect when $\propto \geqq -\sin^{-1}(R_r/L)$) and assuming a worst case value for a, a simple ratio of geometric parameters can be found.

$$f_s \cdot \frac{R_r \cdot R_1}{R_4 \cdot L} \geqq 1.$$

Equation 10 should be vary useful in the early design stages. If a given mechanism satisfies this, the mechanism should pick any media up to the maximum torque the machine can provide.

After the geometry is defined, one should use Equation 9 to determine the location of the center of gravity and the weight of the mechanism. These parameters should be set such that the weight's contribution to normal force does not exceed the smallest normal force expected from the lightest of media. This will prevent double and pack feeding. Furthermore, the operating parameters, with regard to ∝, should be adjusted to that the buckling force acting on the system does not add to the torque required by the system.

What is claimed is:

1. A paper feed assembly comprising a paper tray to hold a stack of sheets to be fed, a gear train having a driven gear, said gear train being mounted for rotation on a pivot located at the center of said driven gear, driving of said gear train in the paper feed direction placing a torque on said gear train around said pivot to force said gear train toward said tray, a paper drive roller integral with a gear at the end of said gear train, and a rotatable member positioned to extend through a hole in the bottom of said paper tray and biased toward said hole by a resilient member to contact said drive roller when said paper tray is empty to permit rotation of said drive roller when said paper tray is empty.

2. A paper feed assembly comprising a paper tray to hold a stack of sheets to be fed, a gear train having a driven gear, said gear train being mounted for rotation on a pivot located at the center of said driven gear, driving of said gear train in the paper feed direction placing a torque on said gear train around said pivot to force said gear train toward said tray, a paper drive roller integral with a gear at the end of said gear train, a corner buckler located at the edge of said tray to bow sheets from said stack driven by said drive roller, said corner buckler being mounted on an arm pivoted under said paper tray to pivot said corner buckler into the stack during a pick operation, and a rotatable member positioned to extend through a hole in the bottom of said paper tray and biased toward said hole by a resilient member to contact said drive roller when said paper tray is empty to permit rotation of said drive roller when said paper tray is empty.

3. A paper feed assembly comprising a paper tray to hold a stack of sheets to be fed, a gear train having a driven gear, said gear train being mounted for rotation on a pivot located at the center of said driven gear, driving of said gear train in the paper feed direction placing a torque on said gear train around said pivot to force said gear train toward said tray, a paper drive roller integral with a gear at the end of said gear train, said gear train being located at the side of said paper tray and said paper drive roller being connected in a cantilever configuration to extend over said stack of sheets held in said tray, said pivot of said gear train being located at a level opposite a level in said paper tray which contains paper when said paper tray is in normal use to limit the angular variation of said drive train.

4. The paper feed assembly of claim 3 also comprising a corner buckler located at the edge of said tray to bow sheets from said stack driven by said drive roller, said corner buckler being mounted on an arm pivoted under said paper tray to pivot said corner buckler into the stack during pick operation.

5. The paper feed assembly of claim 4 also comprising a rotatable member positioned to extend through a hole in the bottom of said paper tray and to contact said drive roller when said paper tray is empty to permit rotation of said drive roller when said paper tray is empty.

6. The paper feed assembly of claim 3 also comprising a rotatable member positioned to extend through a hole in the bottom of said paper tray and to contact said drive roller when said paper tray is empty to permit rotation of said drive roller when said paper tray is empty.

* * * * *